US008784583B2

(12) United States Patent
Pile et al.

(10) Patent No.: US 8,784,583 B2
(45) Date of Patent: Jul. 22, 2014

(54) PRIMING MIXTURES FOR SMALL ARMS

(75) Inventors: Donald Allen Pile, Cabot, AR (US); Henry J. John, Jr., Jacksonville, AR (US)

(73) Assignee: RA Brands, L.L.C., Madison, NC (US)

( * ) Notice: Subject to any disclaimer, the term of this patent is extended or adjusted under 35 U.S.C. 154(b) by 326 days.

(21) Appl. No.: 10/764,246

(22) Filed: Jan. 23, 2004

(65) Prior Publication Data

US 2005/0183805 A1 Aug. 25, 2005

(51) Int. Cl.
*C06B 25/34* (2006.01)

(52) U.S. Cl.
USPC ..... 149/61; 149/92; 149/39

(58) Field of Classification Search
CPC ..... C06B 25/34; C06B 31/02; C06B 31/12
See application file for complete search history.

(56) References Cited

U.S. PATENT DOCUMENTS

| | | | | |
|---|---|---|---|---|
| 1,930,653 | A | 10/1933 | McNutt | |
| 2,111,203 | A | 3/1938 | Brün | |
| 3,155,553 | A | 11/1964 | Taylor et al. | |
| 3,622,408 | A | 11/1971 | Lyerly | 149/109 |
| 3,719,148 | A | 3/1973 | Gawlick et al. | |
| 3,793,920 | A | 2/1974 | Sheran | |
| 4,092,186 | A | 5/1978 | Gordon et al. | 149/10 |
| 4,094,028 | A | 6/1978 | Fujiyama et al. | 9/321 |
| 4,243,444 | A | 1/1981 | Alley et al. | 149/98 |
| 4,280,409 | A | 7/1981 | Rozner et al. | 102/364 |
| 4,363,679 | A | 12/1982 | Hagel et al. | 149/37 |
| 4,372,213 | A | 2/1983 | Rozner et al. | 102/301 |
| 4,386,567 | A | 6/1983 | Ciccone et al. | |
| 4,398,977 | A | 8/1983 | Webster, III | 149/42 |
| 4,419,153 | A | 12/1983 | Boberg | 149/22 |
| 4,522,665 | A | 6/1985 | Yates, Jr. et al. | |
| 4,557,771 | A | 12/1985 | Bencz et al. | 149/14 |
| 4,581,082 | A | 4/1986 | Hagel et al. | 149/105 |
| 4,674,409 | A | 6/1987 | Lopata et al. | 102/471 |
| 4,853,052 | A * | 8/1989 | Calsson et al. | 149/109.6 |
| 4,994,125 | A | 2/1991 | Mei | |
| 5,167,736 | A | 12/1992 | Mei et al. | 149/22 |
| 5,216,199 | A | 6/1993 | Bjerke et al. | 102/471 |
| 5,221,808 | A | 6/1993 | Werner et al. | 102/307 |
| 5,339,624 | A | 8/1994 | Calsson et al. | 60/207 |
| 5,372,070 | A | 12/1994 | Neidert et al. | 102/290 |
| 5,388,519 | A | 2/1995 | Guindon et al. | 102/292 |
| 5,413,048 | A | 5/1995 | Werner et al. | 102/307 |
| 5,463,956 | A | 11/1995 | Harting | 102/282 |
| 5,472,534 | A | 12/1995 | Wardle et al. | 149/36 |
| 5,472,647 | A | 12/1995 | Blau et al. | 264/3.1 |
| 5,501,823 | A | 3/1996 | Lund et al. | 264/3.1 |
| 5,538,569 | A | 7/1996 | Carter | 149/105 |
| 5,561,260 | A | 10/1996 | Towning et al. | 102/336 |
| 5,567,252 | A | 10/1996 | Mei et al. | 149/22 |
| 5,567,906 | A | 10/1996 | Reese et al. | 102/307 |
| 5,585,594 | A | 12/1996 | Pelham et al. | 102/336 |
| 5,610,367 | A | 3/1997 | Erickson et al. | 149/35 |
| 5,639,987 | A | 6/1997 | Berteleau et al. | 149/19.8 |
| 5,646,367 | A | 7/1997 | Shanks et al. | |
| 5,652,409 | A | 7/1997 | Thompson et al. | 149/98 |
| 5,654,520 | A * | 8/1997 | Boberg et al. | 102/205 |
| 5,656,791 | A | 8/1997 | Reese et al. | 102/307 |
| 5,682,014 | A | 10/1997 | Highsmith et al. | 149/36 |
| 5,684,268 | A | 11/1997 | Lopata | 149/39 |
| 5,831,208 | A | 11/1998 | Erickson | 149/18 |
| 5,970,703 | A | 10/1999 | Hinshaw et al. | 60/219 |
| 5,993,577 | A | 11/1999 | Erickson et al. | 149/68 |
| 6,024,810 | A | 2/2000 | Neidert et al. | 149/19.8 |
| 6,066,214 | A | 5/2000 | Comfort | 149/19.4 |
| 6,183,574 | B1 | 2/2001 | Warren | 149/109.6 |
| 6,190,474 | B1 | 2/2001 | Yamato | 149/19.1 |
| 6,241,281 | B1 | 6/2001 | Hinshaw et al. | 280/741 |
| 6,274,064 | B1 | 8/2001 | Wheatley | 252/186.21 |
| 6,478,903 | B1 * | 11/2002 | John et al. | 149/18 |
| 6,503,350 | B2 | 1/2003 | Martin et al. | 149/37 |
| 6,517,647 | B1 | 2/2003 | Yamato | 149/45 |
| 6,878,221 | B1 * | 4/2005 | Mei et al. | 149/41 |
| 2001/0000387 | A1 | 4/2001 | Yamato | 149/19.1 |
| 2002/0007886 | A1 | 1/2002 | Neidert et al. | 149/49 |
| 2002/0053377 | A1 | 5/2002 | Martin et al. | 149/17 |
| 2002/0117071 | A1 | 8/2002 | Kaliszewski | 102/335 |
| 2003/0019387 | A1 | 1/2003 | Yamato et al. | 102/530 |
| 2003/0030162 | A1 | 2/2003 | Yamamoto et al. | 264/3.3 |

FOREIGN PATENT DOCUMENTS

| | | | |
|---|---|---|---|
| DE | 196 25 897 | A1 | 1/1997 |
| EP | 0 310 580 | A | 4/1989 |
| EP | 0 599 792 | A | 6/1994 |
| EP | 0 599 792 | A1 | 6/1994 |
| EP | 0 699 646 | A | 3/1996 |
| EP | 0 538 135 | B1 | 5/1997 |
| EP | 0 861 817 | A | 9/1998 |
| EP | 0 997 449 | A1 | 5/2000 |
| EP | 1 195 366 | A2 | 4/2002 |
| SE | 9203571-8 | | 7/1994 |
| WO | WO 97/16397 | A | 5/1997 |
| WO | WO 99/44968 | | 9/1999 |
| WO | WO 01/10677 | A2 | 2/2001 |
| WO | WO 01/21588 | A | 3/2001 |

* cited by examiner

*Primary Examiner* — Aileen B Felton
(74) *Attorney, Agent, or Firm* — Womble Carlyle Sandridge & Rice, LLP

(57) ABSTRACT

A primer for small arms ammunition including a primary explosive and an oxidizer system containing bismuth oxide is provided. A method of forming the primer and a small arms ammunition cartridge also is provided. The oxidizer system can be non-hygroscopic and non-toxic. The primer can include reducing agents or fuels, sensitizers, binders and gas producing agents.

27 Claims, No Drawings

PRIMING MIXTURES FOR SMALL ARMS

TECHNICAL FIELD

The present invention generally relates to primer charges or mixes and more particularly to priming mixes for small arms ammunition.

BACKGROUND

The smallest component in small arms ammunition, the primer, is the link between the striking of the firing pin and the explosion of the projectile out of the cartridge casing. Generally, most common primer mixes are comprised of a primary explosive, an oxiding agent and a fuel source. Percussion primers and/or primer mixes have undergone relatively few gradual changes since their original development. In early primers, mercury fulminate was the most commonly used primer mix. Since that time, alternate priming mixes have replaced mercury fulminate, as this latter composition was found to deteriorate rapidly under tropical conditions and cause potential health problems or concerns such as lethargy and nausea to the shooter after firing. Such alternate mixes, typically based on lead thiocyanate/potassium chlorate formulations, however, were found to be detrimental to weapon barrels because of the formation of corrosive water soluble potassium chloride salts upon combustion. More conventional primer mixes currently in use typically are based on the primary explosive lead styphnate, a substance which is much more stable than mercury fulminate and is in common use today.

Although more stable and less corrosive than earlier primer mixes, the use of lead styphnate-based primers has become more of a concern recently due to increasing awareness of the health hazards of lead. While considerable attention has been directed to removing lead from primer mixes, however, there has been less attention paid to the removal of the remaining toxic components from the primer mix. One of most common oxidizing agents used in conventional primer mixes is barium nitrate. Unfortunately, barium is highly toxic, and therefore poses a potential health hazard, particularly when used within an enclosed shooting area where it can accumulate in the atmosphere and on surfaces. Generally, a typical small arms primer contains between 30% and 50% oxidizer, so replacing barium nitrate with a non-toxic oxidizer greatly reduces the post-ignition airborne hazards.

Alternative oxidizers, such as potassium nitrate, have been found to perform as well as barium nitrate under certain circumstances or conditions. For example, inorganic nitrate salts perform very well as oxidizing agents in pyrotechnic formulations because of their relatively low melting points, available oxygen, and their crystalline form; however, such nitrate salts such as potassium nitrate, are hygroscopic, making them very susceptible to the effects of atmospheric moisture and inappropriate for use in certain storage conditions. Since priming formulations typically are assembled in high moisture environments to escape unintended ignition by heat, shock, or impact, many oxidizers, such as inorganic nitrates, can cause deleterious side chemical reactions when combined with other ingredients under such high-moisture conditions. Such reactions produce an inferior product with reduced sensitivity to impact and thus ignition, consequently increasing potential failure rates for such primers.

Accordingly, there exists a need for a priming mixture for small arms ammunition that addresses the foregoing and other related and unrelated problems in the art.

SUMMARY

Briefly described, the present invention generally encompasses compositions and methods of preparing priming mixtures for small arms ammunition comprising oxidizer systems containing bismuth oxide, as well as small arms ammunition cartridges that incorporate such priming mixtures. The oxidizer systems can include bismuth oxide alone or in combination with one or more other oxidizers. The priming mixtures further generally will include one or more primary explosives combined with oxidizer systems containing bismuth oxide. In one embodiment, the oxidizer systems containing bismuth oxide are non-hygroscopic and non-corrosive. The priming mixtures of the present invention further can be non-toxic and substantially free of lead, or can contain some lead compound, such as lead styphnate as a primary explosive charge while substantially reducing the overall content of toxic materials in the priming mixture.

In one embodiment, the priming mixtures of the present invention include a primary explosive and a non-hygroscopic, non-corrosive oxidizer system comprising bismuth oxide. The primary explosive may be selected from heavy metal salts of trinitroresorcinol, dinitrobenzofuroxan, diazodinitrophenol and combinations thereof. The primary explosive also may include a lead-based compound such as lead styphnate. In addition to bismuth oxide, the non-hygroscopic, non-corrosive oxidizer system may include one or more additional oxidizer compounds or elements, such as potassium nitrate, zinc peroxide, manganese dioxide, molybdenum trioxide, strontium nitrate, strontium peroxide, tin oxide, iron oxide and combinations thereof. Still further, the priming mixtures containing a primary explosive and a non-hygroscopic, non-corrosive oxidizer system comprising bismuth oxide also may include one or more reducing agents, gas producing agents and sensitizers to provide the desired or required performance characteristics for supplying a priming charge to a round of small arms ammunition.

In another embodiment, the present invention includes priming mixtures for small arms ammunition comprising approximately 20-70% by weight of a primary explosive, such as a lead-free explosive or a lead-based compound such as lead styphnate, and approximately 10-70% by weight of an oxidizer system comprising bismuth oxide. These priming mixtures optionally may include approximately 0-25% by weight of a gas producing agent, approximately 0-20% by weight of a sensitizer, and approximately 0-20% by weight of a reducing agent. The oxidizer systems of these priming mixtures may include, in addition to bismuth oxide, oxidizers selected from potassium nitrate, zinc peroxide, manganese dioxide, molybdenum trioxide, strontium nitrate, strontium peroxide, barium nitrate, tin oxide, iron oxide and combinations thereof. The gas producing agents may be selected from pentaerythritol tetranitrate, trinitrotoluene and/or combinations thereof, while the reducing agents may be selected from aluminum, boron, calcium silicide, magnesium, magnesium-aluminum alloy, silicon, titanium, tungsten, zirconium and combinations thereof.

The priming mixtures typically are wet processed during production for safety, and are formed by methods comprising combining and mixing water with a primary explosive and an oxidizer system comprising bismuth oxide. In alternative embodiments, one or more reducing agents, gas generating agents or sensitizers also can be added during combination and mixing to form the priming mixtures of the present invention. In a further embodiment, water may be combined and mixed with, on a dry weight percent basis, approximately 20-70% by weight of a primary explosive, approximately 10-70% by weight of an oxidizer system comprising bismuth oxide, approximately 0-25% by weight of a gas producing agent, approximately 0-20% by weight of a sensitizer, and approximately 0-20% by weight of a reducing agent. The wet formed priming mixture then can be rolled and charged into percussion cups.

These and other aspects of the present invention are set forth in greater detail below.

DETAILED DESCRIPTION

The present invention generally is directed to priming mixtures containing bismuth oxide primarily for use in small arms ammunition. The priming mixtures generally include a primary explosive and an oxidizer system containing bismuth oxide by itself or in combination with one or more other oxidizers. Other priming components, such as gas producing agents, sensitizers, and reducing agents or fuels also may be included in the priming mixtures of the present invention. These priming mixtures can be incorporated into small arms ammunition primers or cartridges, which also are encompassed by the present invention.

Bismuth oxide as used herein is also referred to as bismuth (III)oxide or $Bi_2O_3$. As used herein, the term "small arms ammunition" refers to ammunition for a firearm capable of being carried by a person and fired without mechanical support and typically having a bore diameter of about one inch or less. The term "priming mixture", as used herein, refers to a combination of explosive and/or pyrotechnic type ingredients, which, when pressed into caseless ammunition or a primer cup or spun into the rim cavity of a rimfire shell, will explode or deflagrate upon impact by a firing-pin with the round of ammunition to ignite the propellant of the round and fire the bullet or slug of the round. The term "primary explosive" generally refers to a sensitive explosive which nearly always detonates by simple ignition from an energy source of appropriate magnitude for a small arm, such as spark, flame, impact and other primary heat sources. The term "primary explosive" further generally includes, but is not limited to, mercury fulminate, lead azide, lead styphnate, silver azide, diazodinitrophenol (DDNP), tetrazene, potassium dinitrobenzofuroxane (KDNBF), heavy metal salts of 5-nitrotetrazole and other compounds that exhibit performance characteristics of handling, storage or detonation similar to these example compounds.

As used herein, the term "non-corrosive primer" refers to a primer which does not contain chemical compounds that typically will produce corrosion or rust in a gun barrel. The term "substantially free of lead", as used herein, refers to the complete absence of lead or the presence of lead in a trace amount or an amount that would not be considered toxic. As used herein, the term "non-toxic" refers to a compound or mixture that contains no more than trace amounts of lead, manganese, antimony and barium, or amounts of these compounds that are considered to be non-detrimental to human health. The term "non-hygroscopic", as used herein, generally refers to an article, compound, or system that does not readily taking up and retain moisture, especially when exposed to humidity. Additionally, the term "cartridge", as used herein, refers to a round of ammunition comprising a case, as well as caseless ammunition, and having a priming mixture and propellant with or without one or more projectiles.

The present invention generally is directed to priming mixtures comprising an oxidizer system containing bismuth oxide. The oxidizer system can include bismuth oxide alone or in combination with one or more other or secondary oxidizers, such as potassium nitrate, zinc peroxide, manganese dioxide, molybdenum trioxide, strontium nitrate, strontium peroxide, barium nitrate, tin oxide, and iron oxide. These secondary oxidizers can be present in the oxidizer system in a range of generally about 0% to particularly about 99% by weight, about 10% to about 90% by weight, and more particularly about 30% to about 60% by weight. Although bismuth oxide has a relatively high melting point of 817° C. as compared to other oxidizers commonly used in small arms ammunition priming mixtures, bismuth oxide is substantially non-hygroscopic and non-toxic, thereby providing certain advantages in storage, handling and use that are not found in other oxidizers. Bismuth oxide also has a texture that allows it flow with ease when blended in the traditional manner in which primer formulations are blended to thus provide a substantially homogenous mixture without having to incorporate flowing agents or implement strenuous particle size control procedures. Therefore, the oxidizer systems of the present invention can be substantially free of flowing agents and can exhibit a range of particle sizes that is broader than those found in conventional homogenous oxidizer systems. A substantially homogeneous priming mixture generally is easier to measure out into the primer cup and process than non-homogeneous mixtures that commonly arise with traditional oxidizer systems. Furthermore, raw dry and wet priming mixtures formed with bismuth oxide generally are less sensitive to external stimulus, such as impact or friction, than those formed with traditional oxidizer systems, thus making the mixtures containing bismuth oxide generally safer to handle, process, and utilize.

In particular embodiments, the priming mixtures of the present invention can include from about 10% to about 70% by weight of an oxidizer system comprising bismuth oxide alone or in combination with one or more other oxidizers, although greater or lesser amounts of the oxidizer can be used. In certain embodiments, the priming mixtures can contain about 25% to about 55% by weight of an oxidizer system including bismuth oxide. This bismuth oxide can constitute anywhere from about 1% up to about 100% by weight of the oxidizer system, and particularly about 5% to about 100% by weight of the oxidizer system.

In addition to a bismuth oxide oxidizer system, the priming mixtures of the present invention generally include one or more primary explosives, such as, for example, lead salts of trinitroresorcinol, diazodinitrophenol, or earth metal salts of dinitrobenzofuroxan. In one embodiment, the priming mixture includes DDNP as one of the primary explosive constituents. DDNP can be used alone, or in combination with one or more other primary explosives, such as KDNBF, and derivatives and mixtures thereof, in the priming mixture. Alternatively, KDNBF may constitute the only primary explosive of the priming mixtures or comprise one of a combination of primary explosive components, other than DDNP. While DDNP and KDNBF are substantially free of lead and non-toxic, they can be used individually or together in combination with one or more lead-based primary explosives, such as lead styphnate or the like, in the priming mixtures containing bismuth oxide. Generally, the primary explosive, whether composed of a single compound or a combination of two or more compounds, will be selected or designed to have ballistic properties similar to or better than those of lead styphnate.

The priming mixtures of the present invention typically will include one or more primary explosives in a range of about 20% to about 70% by weight of the priming mixture, although it is also possible to utilize greater or lesser percentages by weight of the primary explosive in the primary mixture as well. In one embodiment, the primary explosive constitutes about 25% to about 50% by weight of the priming mixture. In a more particular embodiment, the priming mixture generally comprises about 40% to about 45% by weight of a primary explosive, such as KDNBF or DDNP.

The priming mixtures of the present invention also can include one or more secondary explosives, which typically act as sensitizers that accelerate or otherwise modify the rate of conversion of the pyrotechnic system. There are a variety of sensitizers capable of being included in the present priming mixture. In the present case, the sensitizer is selected, in part, for its compatibility with the chosen primary explosive. The sensitizer can enhance the sensitivity of the primary explosive to the percussion mechanism. In one embodiment, tetrazene is selected as a secondary explosive to be combined with a primary explosive, such as DDNP or KDNBF. Tetrazene, also known as tetracene, tetrazolyl guanyltetrazene hydrate or tetrazene-1-carboxamidine-4-(1-H-tetrazol-5-yl) monohydrate, also can be added to the priming mixture, in combination with DDNP or KDNBF, to increase the sensitivity of the charge.

The priming mixtures also can include sensitizers, typically in an amount from about 0% to about 30% by weight of the priming mixture. The sensitizer can include one or more secondary explosives, such as tetrazene, friction agents, such as ground glass, or other inert substances. In one embodiment, the priming mixture contains about 5% to about 20% by weight of such materials, and in one particular embodiment, tetrazene typically is added to the mix in an amount between about 4 to 11% by weight. For example, tetrazene can comprise about 5% by weight of the priming mixture.

Gas producing agents also can be included in the priming mixtures of the present invention. Single or double based propellants, such as pentaerythritol tetranitrate or trinitrotoluene, can be included to provide sources of expanding gas when the priming mixture is activated. Generally, the priming mixtures can include about 0% to about 25% by weight of one or more gas producing agents. In one particular embodiment, the priming mixture comprises about 5% to about 25% by weight of a gas producing agent.

The priming mixtures further can include one or more fuels or reducing agents. The fuel can be either a metallic fuel or reducing agent, nonmetallic fuel, or combinations thereof. The fuel can constitute from about 0% to about 20% by weight of the priming mixture. Examples of potential fuels or reducing agents include aluminum, boron, calcium silicide, magnesium, magnesium-aluminum alloy, silicon, titanium, tungsten, zirconium and nitrocellulose. In one embodiment, the priming mixture includes about 5% to about 20% by weight of a fuel or reducing agent.

The primer mixtures also can contain a binder that is generally included up to about 2% by weight to minimize dusting. The binder typically can constitute about 0.5 to about 1.5% by weight of the priming mixture although other, varying amounts also can be used. The binder generally is chosen for maximum compatibility with the explosive formulation prepared, and typically will be selected from a variety of gum materials, such as gum arabics, and particularly acacia gum arabic, as well as carboxy methylcellulose, ethyl cellulose, and guar tragacanth, polyvinyl alcohol with guar gum.

The disclosed components of the priming mixtures can be combined and wet mixed by the use of standard low shear mixers, using customary techniques for blending explosives. The components typically are wet-mixed for safety since the explosive compounds are desensitized when mixed with water. Also, the components can be dry mixed using a technique called diapering, which is done behind a barricade. With these techniques, the explosive components are generally blended first, followed by the fuels, and finally the oxidizer components.

By way of example and illustration, and not by limitation, the mixing and preparation of the priming mixture is illustrated below by the following steps. Other components may be added to the mixture as described above, and the recited priming mixture is not to be limited by any one proscribed process, but only by the appended claims.

The priming mixture may be prepared and applied by the following steps:

1. Within the above-described ranges, primary and secondary explosives are added in a kettle mixer with an amount of water and then mixed for approximately 2 minutes. When added to the kettle, the primary and secondary explosives generally are wet with water. This moisture generally is sufficient to wet the entire mixture.
2. Within the above-described ranges, fuels or other sensitizers are added to the wet mix of explosives and then mixed for approximately 2 minutes.
3. Within the above-described ranges, the oxidizer system containing bismuth oxide is added to the wet mix of explosives and fuel and then mixed for about 2 minutes. Subsequently, the entire mixture is mixed for about 3 minutes to form the wet mix primer.
4. The resulting wet priming mixture is rolled onto plates having holes or recesses wherein the wet mixture is formed into pellets and then punched and charged into primer cups. The resulting charged priming mixture is then covered with a paper foil and an anvil is inserted. The charged priming mixture is then typically allowed to dry for approximately 5 days at about 50° C.

The present invention also encompasses small arms ammunition cartridges that incorporated the priming mixtures described herein. The cartridges typically will include a case in which the priming mixture is disposed, although the primer mixture also could be used for caseless ammunition as well. The cartridge may include projectiles, such as shot or bullets. The cartridge also can be a centerfire cartridge for rifles, pistols and revolvers in which the primer is centrally aligned within the head of the cartridge or a rimfire cartridge having a flanged head with the priming mixture disposed in the rim cavity.

EXAMPLES

Example 1

A standard primer contains a mixture conventional formulation of 35.6% lead styphnate, 5% tetrazene, 40.6% barium nitrate, 11.9% antimony sulfide, and 6.9% aluminum with an additional 0.5% of binder (Conventional Formulation). To demonstrate the ability of bismuth oxide to act as a direct replacement for more common oxidizers, in this case barium nitrate, an alternative mixture was prepared by substituting bismuth oxide for barium nitrate in the conventional formulation. This alternative mixture is referred to as BI01. Both mixes were prepared by mixing water-wet explosives with the mentioned dry ingredients in a production fashion. Once mixed these were then assembled into small arms primers. After drying, these primers were then tested according to the SAAMI specification for small arms ammunition sensitivity. The accepted performance standard requires that no sample fires when a 1.94 ounce test weight is dropped from a height of 1 inch into the priming mixture and that all samples must fire when the weight is dropped from a height of 11 inches.

When the priming mixture was tested in 38 Special shells, the results of Table 1 were obtained.

TABLE 1

| 50 samples tested at each level | | |
|---|---|---|
| | Conventional Formulation | BI01 |
| all fire height, in. | 6 | 6 |
| all no-fire height, in. | 2 | 2 |
| X-bar | 3.62 | 4.16 |
| X-bar + 4σ | 6.35 | 7.11 |
| X-bar − 2σ | 2.26 | 2.68 |

From the results of the sensitivity test shown in Table 1, it is apparent that although there is some difference in sensitivity between the two, both samples are well within the SAAMI guidelines, and it can be seen that the bismuth oxide in BI01 meets the SAMMI performance standards.

An additional comparison was performed by using the above two primer samples and loading them into 9 mm rounds of ammunition using 115 grain metal case bullet and Bullseye® propellant. The loaded 9 mm rounds of ammunition were then fired at various temperatures while measuring peak chamber pressure and muzzle velocity. Table 2 indicates the results when tested in 9 mm ammunition.

TABLE 2

| average of 50 rounds | | | | | |
|---|---|---|---|---|---|
| sample | storage | peak pressure, 100 psi | standard deviation | muzzle velocity, ft/sec | standard deviation |
| Conventional | 70° F. | 313 | 20 | 1137 | 27 |
| BI01 | 70° F. | 325 | 13 | 1215 | 19 |
| Conventional | 150° F. | 356 | 17 | 1162 | 28 |
| BI01 | 150° F. | 353 | 11 | 1267 | 16 |
| Conventional | −20° F. | 304 | 25 | 1104 | 38 |
| BI01 | −20° F. | 339 | 23 | 1202 | 29 |

The results of Table 2 indicate that the BI01 formulation containing bismuth oxide as the main oxidant performed equal to or better than the Conventional Formulation on peak pressure and exhibited higher muzzle velocity after every storage condition. The performance of the bismuth oxide primer formulation is consistent over a wide range of temperatures. In each of case, the equilibrium time was 48 hours. Also, 50 rounds were fired at each condition. Although this example was performed in 9 mm, it can be inferred that this improvement will transfer to all small arms ammunition.

Example 2

To illustrate the compatibility of bismuth oxide with other primer components and the versatility of bismuth oxide in various primer mixes, four different mixes were prepared using bismuth oxide in combination with various oxidizers. Mix descriptions are found in Table 3.

TABLE 3

| percent by weight dry ingredients | | | | |
|---|---|---|---|---|
| | BI02 | BI03 | BI04 | BI05 |
| KDNBF | 45 | 45 | 45 | 45 |
| Tetrazene | 5 | 5 | 5 | 5 |
| Bismuth Oxide | 15 | 15 | 15 | 15 |

TABLE 3-continued

| percent by weight dry ingredients | | | | |
|---|---|---|---|---|
| | BI02 | BI03 | BI04 | BI05 |
| Zinc Peroxide | 30 | | | |
| Potassium Nitrate | | 30 | | |
| Strontium Peroxide | | | 30 | |
| Molybdenum Oxide | | | | 30 |
| Titanium | 5 | 5 | 5 | 5 |

After these mixes were charged into primers, they were dried and primed into 38 Special casings, and tested according to the SAAMI specification for small pistol sensitivity. The results of the sensitivity testing are presented in Table 4.

TABLE 4

| 50 samples tested at each level | | | | |
|---|---|---|---|---|
| | BI02 | BI03 | BI04 | BI05 |
| all fire height, in. | 7 | 9 | 5 | 7 |
| all no-fire height, in. | 3 | 3 | 2 | 5 |
| X-bar | 3.86 | 5.52 | 3.28 | 5.04 |
| X-bar + 4σ | 7.14 | 11.09 | 5.29 | 7.47 |
| X-bar − 2σ | 2.22 | 2.73 | 2.28 | 3.83 |

From Table 4, it is evident that secondary oxidizers can affect the overall sensitivity of the mixture. All but one, BI03, meet the SAAMI specification for X-bar+4σ all-fire sensitivity. This does not mean that the bismuth oxide/potassium nitrate formulation will not perform satisfactorily; a simple alteration to the ratio of the two components can change the sensitivity to meet the specification.

Additional information about each formulation was gathered when each was fired in a semi-closed primer bomb. The results of semi-closed primer bomb are found in Table 5.

TABLE 5

| average of 10 primers fired for each sample | | | | |
|---|---|---|---|---|
| | BI02 | BI03 | BI04 | BI05 |
| time-to-1$^{st}$-rise, μS | 0.273 | 0.295 | 0.366 | 0.434 |
| rise time, μs | 0.106 | 0.117 | 0.200 | 0.293 |
| peak pressure, psi | 242 | 271 | 138 | 171 |
| temperature, K | 1464 | 1675 | 1494 | 1453 |

The data set forth in Table 5 reveals performance variations linked to the selected primary oxidant. This data shows the efficiency of the inorganic nitrate as an oxidizer. To determine how these outputs affected the ballistics properties of loaded ammunition, the above primers were loaded into 9 mm cartridges using a 101 grain frangible bullet with 6.2 grains of HPC-33 propellant. The internal ballistics peak pressure and muzzle velocity for each was obtained. Ballistics data is found in Table 6.

TABLE 6

| average of 10 rounds | | | | |
|---|---|---|---|---|
| | BI02 | BI03 | BI04 | BI05 |
| peak pressure, 100 psi | 382 | 388 | 363 | 342 |
| peak pressure extreme variation, 100 psi | 60 | 39 | 55 | 57 |
| peak pressure standard deviation | 15 | 12 | 17 | 20 |
| muzzle velocity, ft/sec | 1306 | 1317 | 1287 | 1278 |
| muzzle velocity extreme variation, ft/sec | 69 | 57 | 62 | 70 |
| muzzle velocity standard deviation | 18 | 15 | 22 | 23 |

Holding the mass of propellant constant allows the evaluation of the primers ability to ignite the charge. The comparison in Table 6 reveals the effects of changing the dominate oxidant has on ballistics performance. When comparing the effect the different combinations have on primer bomb output, it appears the use of strontium peroxide or molybdenum trioxide drastically decreased the output. However the decreased output was not detrimental to propellant ignition. In any event, the above example demonstrates bismuth oxide's capacity to function in combination with other oxidizers in small arms ammunition. Furthermore, it must be understood that only one type of propellant was used in this example, it maybe the case that the strontium peroxide or molybdenum trioxide containing primers may perform better when using alternative propellant. Although, this is just a few of the unlimited number of possible combinations, it highlights bismuth oxide's capacity to be used in combination with other oxidizers to tailor primer performance.

Example 3

Again the versatility of bismuth oxide is demonstrated in this example where its use as the sole oxidizer in combination with a variety of fuels is presented. As shown in Table 7, eight formulations were produced in which all components and their percentages were kept constant, except that the type of fuel was varied.

TABLE 7

| percent dry ingredients by weight | | | | | | | | |
|---|---|---|---|---|---|---|---|---|
| | BI06 | BI07 | BI08 | BI09 | BI10 | BI11 | BI12 | BI13 |
| KDNBF | 45 | 45 | 45 | 45 | 45 | 45 | 45 | 45 |
| Tetrazene | 5 | 5 | 5 | 5 | 5 | 5 | 5 | 5 |
| $Bi_2O_3$ | 45 | 45 | 45 | 45 | 45 | 45 | 45 | 45 |
| Al | 5 | | | | | | | |
| B | | | | 5 | | | | |
| $CaSi_2$ | | | | | | | 5 | |
| Mg | | | | | | | | 5 |
| MgAl Alloy | | | | | 5 | | | |
| Si | | 5 | | | | | | |
| Ti | | | 5 | | | | | |
| Zr | | | | | | 5 | | |

Once the primer formulations were produced, they were tested for sensitivity in 38 Special casings according to SAAMI specifications. The results of the sensitivity testing are presented in Table 8.

TABLE 8

| 50 samples tested at each level | | | | | | | | |
|---|---|---|---|---|---|---|---|---|
| | BI06 | BI07 | BI08 | BI09 | BI10 | BI11 | BI12 | BI13 |
| all fire height, in. | 7 | 7 | 7 | 6 | 7 | 5 | 5 | 6 |
| all no-fire height, in. | 3 | 3 | 3 | 2 | 2 | 2 | 2 | 2 |
| X-bar | 4.92 | 4.84 | 4.26 | 3.44 | 3.58 | 3.50 | 3.34 | 3.66 |
| X-bar + 4σ | 8.03 | 8.81 | 7.10 | 5.30 | 5.64 | 5.10 | 5.19 | 5.39 |
| X-bar − 2σ | 3.37 | 2.86 | 2.84 | 2.51 | 2.20 | 2.70 | 2.41 | 2.5 |

Each primer formulation met or exceeded the SAAMI specifications for primer sensitivity. Consequently, it is evident that bismuth oxide performs well with a variety of fuels. However, sensitivity is just one of the criteria that a primer must meet. Therefore, the ballistic characteristics of the primer formulations were tested by loading the primers into 9 mm 101 frangible rounds using 6.2 grains of HPC-33. The results are set forth in Table 9.

TABLE 9

| average of 10 samples | | | | | | | | |
|---|---|---|---|---|---|---|---|---|
| | BI06 | BI07 | BI08 | BI09 | BI10 | BI11 | BI12 | BI13 |
| peak pressure, 100 psi | 368 | 407 | 395 | 385 | 389 | 407 | 397 | 385 |
| peak pressure extreme variation, 100 psi | 33 | 67 | 45 | 84 | 50 | 82 | 64 | 56 |
| peak pressure standard deviation | 11 | 19 | 13 | 26 | 16 | 22 | 23 | 21 |
| muzzle velocity, ft/sec | 1297 | 1283 | 1278 | 1273 | 1285 | 1284 | 1279 | 1309 |
| muzzle velocity extreme variation, ft/sec | 37 | 47 | 45 | 37 | 34 | 11 | 46 | 38 |
| muzzle velocity standard deviation | 12 | 16 | 14 | 13 | 11 | 4 | 14 | 13 |

The results illustrate the versatility and compatibility of bismuth oxide in a variety of primer formulations that can be used in small arms ammunition.

While various embodiments have been set forth as illustrated and described above, it is recognized that numerous variations may be made with respect to relative weight percentages of various constituents in the composition. Therefore, while the invention has been disclosed in various forms only, it will be obvious to those skilled in the art that many additions, deletions and modifications can be made without departing from the spirit and scope of this invention, and no undue limits should be imposed, except as to those set forth in the following claims.

What is claimed is:

1. A priming mixture for small arms ammunition comprising:

a primary explosive selected from the group consisting of: trinitroresorcinol, mercury fulminate, lead azide, lead styphnate, silver azide, diazodinitrophenol, tetrazene, potassium dinitrobenzofuroxane, heavy metal salts of 5-nitrotetrazole, and any combination thereof;

a gas producing agent of about 5% to about 20% by weight;

a fuel; and a non-hygroscopic, non-corrosive oxidizer system comprising bismuth oxide, wherein the bismuth oxide comprises at least 15% by weight of the priming mixture.

2. The priming mixture of claim 1, wherein the oxidizer system further comprises a secondary oxidizer selected from potassium nitrate, zinc peroxide, manganese dioxide, molybdenum trioxide, strontium nitrate, strontium peroxide, tin oxide, iron oxide, or combinations thereof.

3. The priming mixture of claim 1, wherein the gas producing agent is selected from the pentaerythritol tetranitrate, trinitrotoluene, or combinations thereof.

4. The priming mixture of claim 1, wherein the fuel is selected from aluminum, boron, calcium silicide, magnesium, magnesium-aluminum alloy, silicon, titanium, tungsten, zirconium, nitrocellulose, or combinations thereof.

5. The priming mixture of claim 1, wherein the priming mixture is substantially free of lead.

6. The priming mixture of claim 1, wherein the priming mixture is non-toxic.

7. A small arms ammunition cartridge comprising:

a case; and, the priming mixture of claim 1 disposed in the case.

8. A priming mixture for small arms ammunition comprising:

about 20% to about 70% by weight of a primary explosive selected from the group consisting of: trinitroresorcinol, mercury fulminate, lead azide, lead styphnate, silver azide, diazodinitrophenol, tetrazene, potassium dinitrobenzofuroxane, heavy metal salts of 5-nitrotetrazole, and any combination thereof;

about 10% to about 70% by weight of an oxidizer system comprising bismuth oxide, wherein the bismuth oxide comprises at least 15% by weight of the priming mixture;

about 5% to about 25% by weight of a gas producing agent;

about 0% to about 20% by weight of a sensitizer; and, about 5% to about 20% by weight of a reducing agent.

9. The priming mixture of claim 8, wherein the priming mixture comprises about 25% to about 50% by weight of the primary explosive.

10. The priming mixture of claim 8, wherein the priming mixture comprises about 25% to about 55% by weight of the oxidizer system.

11. The priming mixture of claim 8, wherein the priming mixture comprises about 5% to about 20% by weight of the sensitizer.

12. The priming mixture of claim 8, wherein the oxidizer system further comprises a secondary oxidizer selected from potassium nitrate, zinc peroxide, manganese dioxide, molybdenum trioxide, strontium nitrate, strontium peroxide, barium nitrate, tin oxide, iron oxide, or combinations thereof.

13. The priming mixture of claim 8, wherein the oxidizer system is non-hygroscopic.

14. The priming mixture of claim 8, wherein the priming mixture is substantially free of lead.

15. The priming mixture of claim 8, wherein the priming mixture is non-toxic.

16. A small arms ammunition round comprising:

a priming mixture as disclosed in claim 8;

a propellant adapted to be initiated by the priming mixture; and a projectile.

17. A priming mixture for small arms ammunition comprising:

about 25% to about 50% by weight of a primary explosive selected from the group consisting of: trinitroresorcinol, mercury fulminate, lead azide, lead styphnate, silver azide, diazodinitrophenol, tetrazene, potassium dinitrobenzofuroxane, heavy metal salts of 5-nitrotetrazole, and any combination thereof;

a gas producing agent of about 5% to about 15% by weight; and, about 25% to about 55% by weight of an oxidizer system comprising bismuth oxide, wherein the bismuth oxide comprises at least 15% by weight of the priming mixture.

18. The priming mixture of claim of 17, wherein the gas producing agent is selected from pentaerythritol tetranitrate, trinitrotoluene, or combinations thereof.

19. The priming mixture of claim 17, further comprising about 5% to about 20% by weight of a sensitizer.

20. The priming mixture of claim 19, wherein the oxidizer system is non-corrosive and non-hygroscopic.

21. The priming mixture of claim 17, further comprising about 5% to about 20% by weight of a reducing agent.

22. The priming mixture of claim 21, wherein the reducing agent is selected from aluminum, boron, calcium silicide, magnesium, magnesium-aluminum alloy, silicon, titanium, tungsten, zirconium, or combinations thereof.

23. The priming mixture of claim 17, wherein the oxidizer system further comprises an oxidizer selected from potassium nitrate, zinc peroxide, manganese dioxide, molybdenum trioxide, strontium nitrate, strontium peroxide, barium nitrate, tin oxide, iron oxide, or combinations thereof.

24. The priming mixture of claim 17, wherein the priming mixture is substantially free of lead.

25. The priming mixture of claim 1, further comprising a sensitizer.

26. The priming mixture of claim 25, wherein the sensitizer is tetrazene.

27. The priming mixture of claim 1, wherein the gas producing agent comprises a single or double nitrate propellant.

* * * * *